US007619573B2

(12) United States Patent
Jung et al.

(10) Patent No.: US 7,619,573 B2
(45) Date of Patent: Nov. 17, 2009

(54) WIRELESS ANTENNA MODULE, AND DISPLAY DEVICE AND DISPLAY SYSTEM HAVING THE SAME

(75) Inventors: Yong Sub Jung, Suwon-si (KR); Chang Won Ryu, Ansan-si (KR); Woo Suk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 181 days.

(21) Appl. No.: 11/774,158

(22) Filed: Jul. 6, 2007

(65) Prior Publication Data

US 2008/0048919 A1 Feb. 28, 2008

(30) Foreign Application Priority Data

Aug. 23, 2006 (KR) ..... 10-2006-0080146

(51) Int. Cl.
*H01Q 1/24* (2006.01)
*H01Q 1/12* (2006.01)

(52) U.S. Cl. ..... 343/702; 343/878; 343/893

(58) Field of Classification Search ..... 343/702, 343/878, 893; 455/566
See application file for complete search history.

(56) References Cited

U.S. PATENT DOCUMENTS

| | | | | |
|---|---|---|---|---|
| 6,972,721 | B2 * | 12/2005 | Park | 343/702 |
| 7,429,954 | B2 * | 9/2008 | Doczy et al. | 343/702 |
| 2004/0135730 | A1 * | 7/2004 | Yang | 343/702 |
| 2006/0040713 | A1 * | 2/2006 | Kim | 455/566 |

FOREIGN PATENT DOCUMENTS

| | | | |
|---|---|---|---|
| KR | 10-2000-0062803 | A | 10/2000 |
| KR | 10-2003-0058118 | A | 7/2003 |

* cited by examiner

*Primary Examiner*—Hoang V Nguyen
(74) *Attorney, Agent, or Firm*—Sughrue Mion, PLLC

(57) ABSTRACT

A wireless antenna module including a plurality of antennas that can be easily installed in an appliance, and a display device and a display system having the same. The wireless antenna module includes a plurality of antennas that transmit and/or receive radio frequency (RF) signals, and an antenna holder for fixing the antennas to an appliance. The antenna holder includes a plurality of antenna couplers, each antenna coupler coupled with a respective antenna.

21 Claims, 6 Drawing Sheets

WIRELESS ANTENNA MODULE, AND DISPLAY DEVICE AND DISPLAY SYSTEM HAVING THE SAME

CROSS-REFERENCE TO RELATED APPLICATION

This application claims the benefit of Korean Patent Application No. 10-2006-80146, filed on Aug. 23, 2006, in the Korean Intellectual Property Office, the disclosure of which is incorporated herein by reference.

BACKGROUND OF THE INVENTION

1. Field of the Invention

Devices and systems consistent with the present invention relate generally to a wireless antenna module for transmitting and/or receiving radio frequency (RF) signals, and more particularly, to a wireless antenna module including a plurality of antennas that can be easily installed in an appliance, and a display device and a display system having the same.

2. Description of the Prior Art

In general, a display device, such as a digital television (TV), is connected to a set-top box through a cable that transmits video and audio signals output from the set-top box. However, since the cable is readily exposed to the eyes of a user, the beauty of the room may be spoiled by the cable. In order to solve this problem, a display device capable of making wireless communication with an external device, such as a set-top box, has recently been proposed. Korean Patent Publication No. 10-2003-58118 discloses such a display device.

The display device includes a body equipped with a wireless communication unit, which is capable of making wireless communication with an external device. However, if the installation position or the orientation of the display device is changed, the orientation of an antenna receiving RF signals is also changed, and the sensitivity to reception and/or transmission of the antenna is significantly changed.

For this reason, a display device equipped with an antenna system including a plurality of antennas, which are orientated in different directions so as to sufficiently receive RF signals, has been suggested. For instance, Korean Patent Unexamined Publication No. 10-2000-62803 discloses an antenna system for a TV, which can improve receive sensitivity of antennas by employing a plurality of vertical antennas that mainly receive vertical components of RF signals and a plurality of horizontal antennas that mainly receive horizontal components of RF signals.

However, the display device equipped with this kind of antenna system must fix the antennas to the display device one by one by using fixing screws, so installation work for the antennas is very cumbersome and complicated. In addition, since the antennas are fixed to the display device one by one, it is difficult to properly set the orientation of each antenna, and to precisely maintain an interval between the antennas.

SUMMARY OF THE INVENTION

Exemplary embodiments of the present invention overcome the above disadvantages and other disadvantages not described above. Also, the present invention is not required to overcome the disadvantages described above, and an exemplary embodiments of the present invention may not overcome any of the problems described above.

The present invention provides a wireless antenna module including a plurality of antennas that can be easily installed in an appliance, and a display device and a display system having the same.

According to one aspect of the present invention, there is provided a wireless antenna module including: a plurality of antennas that transmit and/or receive radio frequency (RF) signals; and an antenna holder that fixes the antennas to an appliance, wherein the antenna holder includes a plurality of antenna couplers, each antenna coupler coupled with a respective antenna.

The antennas may include a first antenna that mainly receives horizontal components of the RF signals, and a second antenna that mainly receives vertical components of the RF signals, and the antenna couplers may include a first antenna coupler that fixes the first antenna and a second antenna coupler that fixes the second antenna such that an orientation of the second antenna is different from an orientation of the first antenna.

The second antenna coupler may be spaced apart from the first antenna coupler.

Each of the first and second antenna couplers may include recesses that receive the antennas and at least one fixing protrusion that fixes the received antenna in the recess.

The orientation of the second antenna may be perpendicular to the orientation of the first antenna.

The antennas may further include a third antenna that mainly receives horizontal components of the RF signals, and a fourth antenna that mainly receives vertical components of the RF signals, and the antenna couplers may further include a third antenna coupler that fixes the third antenna and a fourth antenna coupler that fixes the fourth antenna such that an orientation of the fourth antenna is different from an orientation of the third antenna.

The fourth antenna coupler may be spaced apart from the third antenna coupler.

Each of the third and fourth antenna couplers may include recesses for receiving the antennas and at least one fixing protrusion that fixes the antenna received in the recess.

According to another aspect of the present invention, there is provided a display device including: a display module that displays images; a case that protects the display module; and a wireless antenna module installed in the case that transmits and/or receives RF signals, wherein the wireless antenna module includes a plurality of antennas that transmit and/or receive the RF signals and an antenna holder for fixing the antennas to an appliance, in which the antenna holder includes a plurality of antenna couplers, each antenna coupler coupled with a respective antenna.

According to still another aspect of the present invention, there is provided a display system including: a display device; an external device separated from the display device that outputs audio and video signals; and wireless antenna modules installed in the display device and the external device, respectively, so as to provide wireless communication between the display device and the external device, wherein the wireless antenna module includes a plurality of antennas that transmit and/or receive RF signals and an antenna holder that fixes the antennas to the display device or the external device, in which the antenna holder includes a plurality of antenna couplers, each antenna coupler coupled with a respective antenna.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, exemplary embodiments of the present invention will be described with reference to the accompanying drawings.

Figure 1:
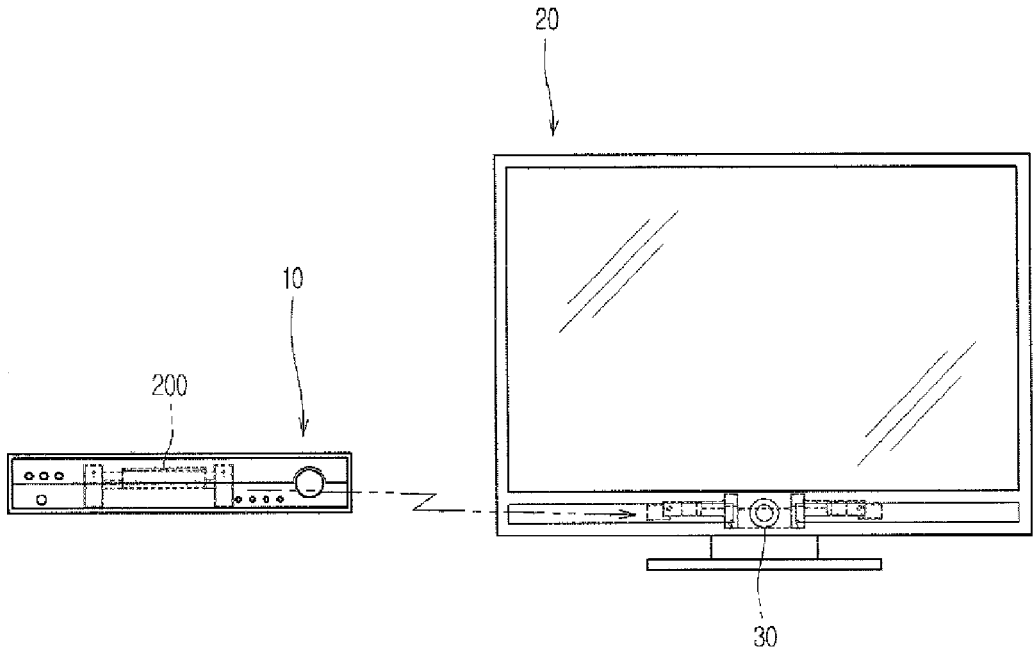
FIG. 1 is a view illustrating a display system equipped with a wireless antenna module according to the exemplary embodiment of the present invention.

As shown in FIG. 1, wireless antenna modules 30 and 200 of the exemplary embodiment of the present invention are installed in a signal converter 10 (i.e., a set-top box) and a display device 20, respectively. The wireless antenna modules provide wireless communication between the signal converter 10 that outputs wireless transmission signals by converting audio and video signals and the display device 20 that displays images. The display device 20 includes a plasma display panel (PDP), a liquid crystal display (LCD), a Braun tube TV or a monitor that displays images on a screen. The signal converter 10 converts video and audio signals received from an external antenna, a video cassette recorder (VCR), or a digital versatile disk (DVD) so as to output wireless transmission signals to the display device 20.

Since video and audio signals are wirelessly transmitted to the display device 20 from the signal converter 10, which is separated from the display device 20, the display device 20 can be installed in various places regardless of the cable.

The wireless antenna modules 30 and 200 installed in the signal converter 10 and the display device 20 are connected to wireless communication modules (not shown) provided in the signal converter 10 and the display device 20, respectively. The wireless antenna modules 30 and 200 have the same functions. Thus, the following description will be made relative to the wireless antenna module 30 installed in the display device 20 in order to avoid redundancy.

Figure 2:
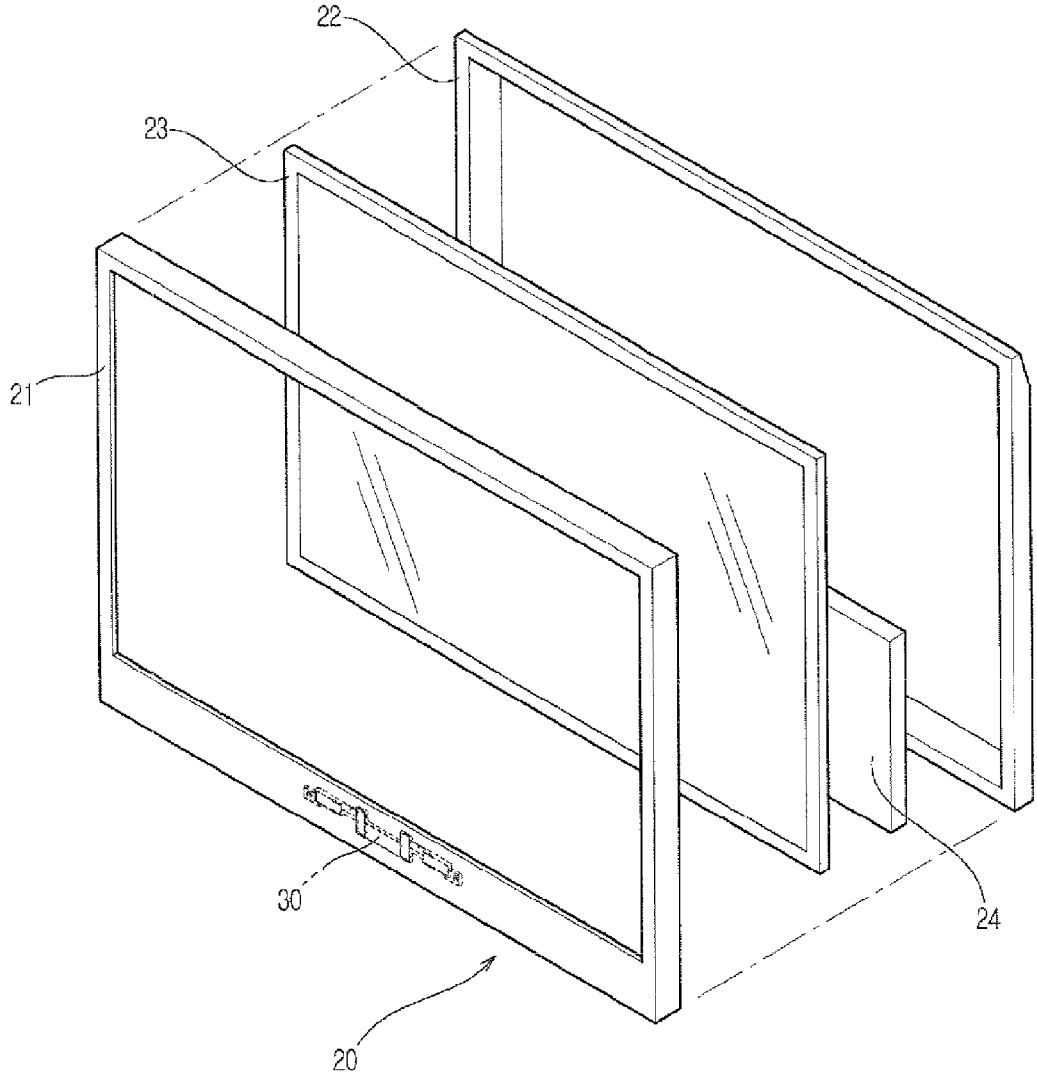
FIG. 2 is an exploded perspective view illustrating a display system equipped with a wireless antenna module according to the exemplary embodiment of the present invention.

FIG. 2 shows a PDP TV as an example of the display device according to the exemplary embodiment of the present invention. The display device 20 includes a display module, front and rear cases 21 and 22 coupled to an outer portion of the display module in order to protect the display module, and a wireless antenna module 30 installed inside of the front case 21.

The display module includes a PDP assembly 23 and a main PCB assembly 24 for driving the PDP assembly 23. The wireless antenna module 30 is connected to a wireless communication module (not shown) which is prepared integrally with or separately from the main PCB assembly 24.

Figure 3:
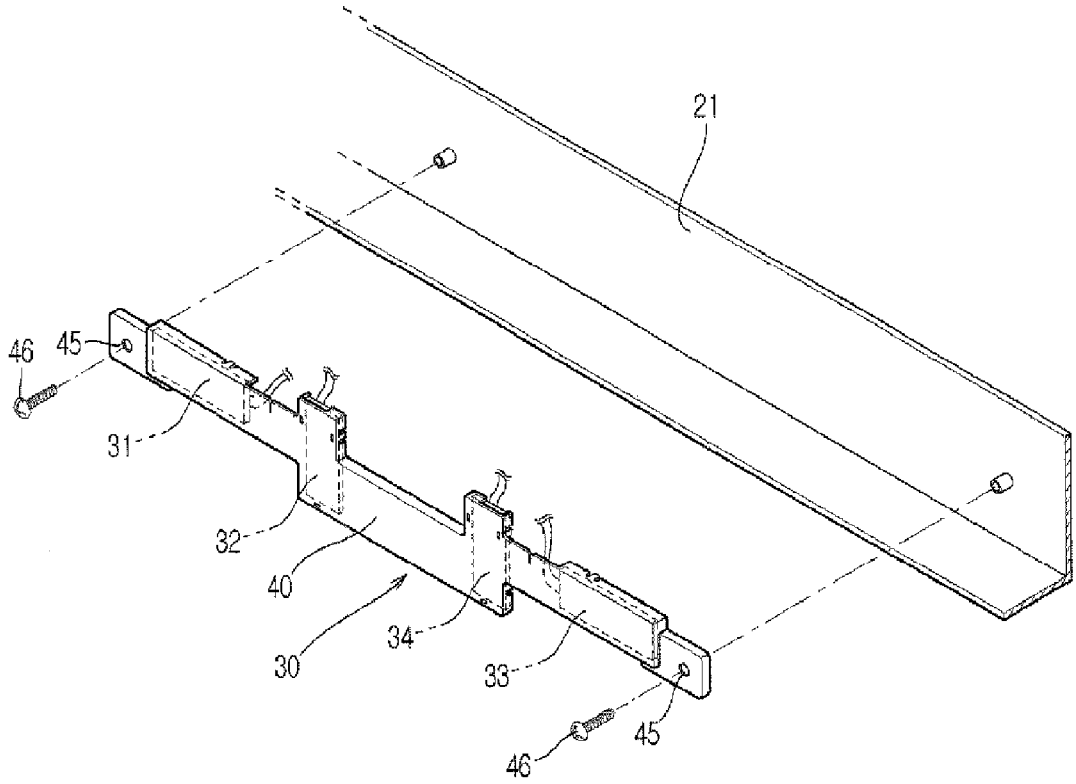
FIG. 3 is a perspective view illustrating a mounting structure of a wireless antenna module according to a first exemplary embodiment of the present invention.
Figure 4:
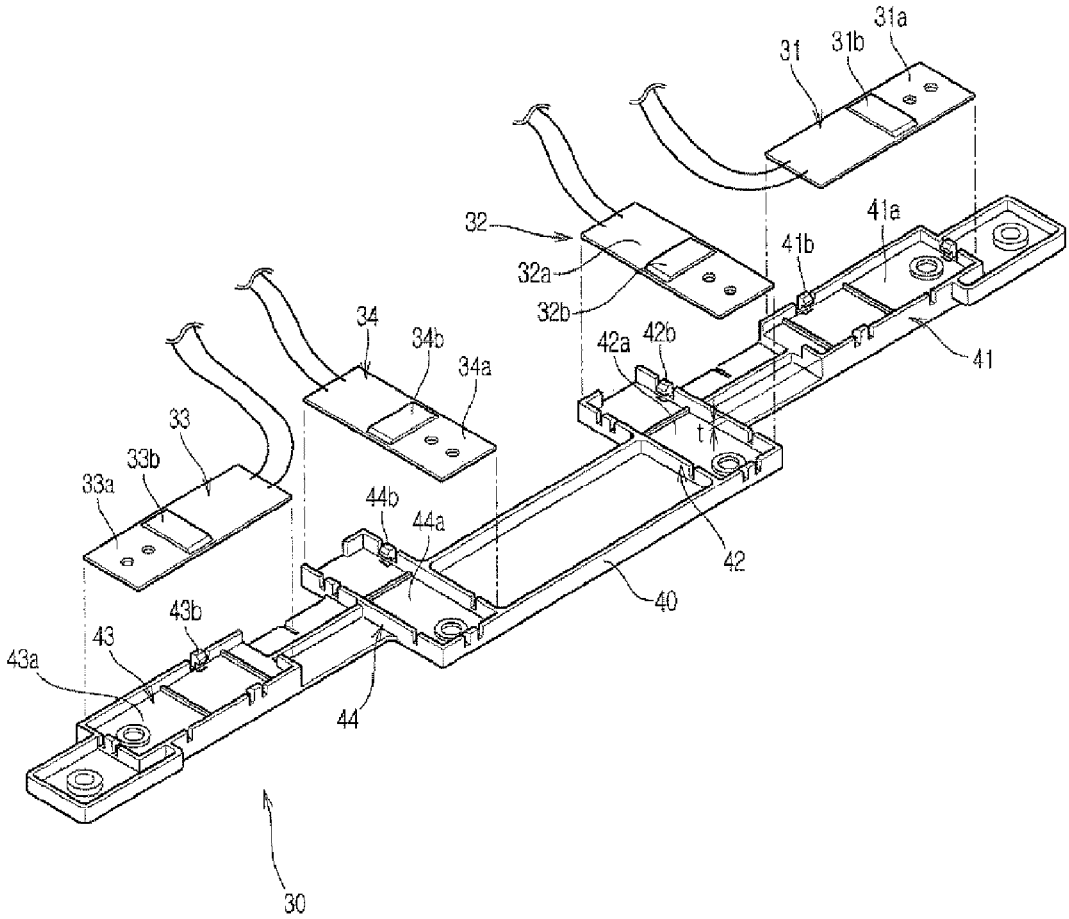
FIG. 4 is an exploded perspective view illustrating a wireless antenna module according to a first exemplary embodiment of the present invention.

FIGS. 3 and 4 show the wireless antenna module 30 according to the first exemplary embodiment of the present invention. The wireless antenna module 30 includes a plurality of antennas 31, 32, 33 and 34 that transmit and/or receive radio frequency (RF) signals, and an antenna holder 40 that fixes the antennas 31, 32, 33 and 34 to an inner surface of the front case 21. The antennas 31, 32, 33 and 34 include printed circuit board (PCB) type transceiver antennas having antenna chips 31*b*, 32*b*, 33*b* and 34*b* connected to flat PCBs 31*a*, 32*a*, 33*a* and 34*a*.

The antennas 31, 32, 33 and 34 are divided into a main antenna set including first and second antennas 31 and 32 and a sub-antenna set including third and fourth antennas 33 and 34, which are spaced apart from the main antenna set. In addition, the first and third antennas 31 and 33 are horizontally arranged so as to mainly receive horizontal components of RF signals, and the second and fourth antennas 32 and 34 are vertically arranged so as to mainly receive vertical components of RF signals.

That is, the first and second antennas 31 and 32 of the main antenna set can receive the RF signals having the horizontal and vertical components, so that the display device 10 can provide wireless communication with the signal converter 10 through the main antenna set. The sub-antenna set including the third and fourth antennas 33 and 34 is used when the main antenna set malfunctions.

As shown in FIG. 3, the antenna holder 40 is an elongated flat plate, so that the antenna holder 40 can be easily installed on the inner surface of the front case 21 of the display device 20. As shown in FIG. 4, the antenna holder 40 includes first to fourth antenna couplers 41, 42, 43 and 44 that fixes the first to fourth antennas 31, 32, 33 and 34.

The first antenna coupler 41 is horizontally arranged so that the first antenna 31 is horizontally installed, and the second antenna coupler 42 is vertically arranged, while being spaced apart from the first antenna coupler 41, so that the second antenna 32 is vertically installed. That is, the second antenna coupler 42 is arranged vertically with respect to the first antenna coupler 41. In addition, the first and second antenna couplers 41 and 42 can be provided on the same plane or can be provided on different planes with a predetermined step difference (t) therebetween by taking the sensitivity of the antennas to reception and/or transmission into consideration. Referring to FIG. 4, the first antenna coupler 41 is higher than the second antenna coupler 42 by about 3 mm, so that the step difference is formed between the first and second couplers 41 and 42. Similarly, the third and fourth antenna couplers 43 and 44 are provided on the other side of the antenna holder 40 in a manner similar to the first and second antenna couplers 41 and 42.

The antenna couplers 41, 42, 43 and 44 include recesses 41*a*, 42*a*, 43*a* and 44*a* that receive the flat PCBs 31*a*, 32*a*, 33*a* and 34*a* of the antennas 31, 32, 33, and 34, respectively. In addition, the antenna couplers 41, 42, 43 and 44 have fixing protrusions 41*b*, 42*b*, 43*b* and 44*b* for fixing the antennas received in the recesses 41*a*, 42*a*, 43*a* and 44*a*, respectively. The fixing protrusions 41*b*, 42*b*, 43*b* and 44*b* include hooks which can be elastically deformed. Therefore, when the antennas 31, 32, 33, and 34 are coupled to the antenna couplers 41, 42, 43 and 44, the flat PCBs 31*a*, 32*a*, 33*a* and 34*a* of the antennas 31, 32, 33, and 34 are press-fitted into the recesses 41*a*, 42*a*, 43*a* and 44*a* in such a manner that edge portions of the flat PCBs 31*a*, 32*a*, 33*a* and 34*a* can be coupled with the fixing protrusions 41*b*, 42*b*, 43*b* and 44*b*.

As shown in FIG. 3, screw holes 45 are formed at both ends of the antenna holder 40. Fixing screws 46, which are screw-coupled into the screw holes 45, fix the antenna holder 40 to the inner surface of the front case 21 of the display device 20. The antenna holder 40 can be integrally fabricated through an injection molding process by using resin materials.

In the wireless antenna module 30 having the above structure, the first to fourth antennas 41, 42, 43, and 44 are press-fitted into the first to fourth antenna couplers 41, 42, 43 and 44, and then the antenna holder 40 is fixed to the inner surface of the front case 21 of the display device 20. Thus, a plurality of antennas can be easily installed. In addition, since the wireless antenna module 30 is installed in the display device 20 in a state in which the first to fourth antennas 41, 42, 43, and 44 have been precisely fixed to the antenna holder 40, the orientation and interval of the first to fourth antennas 41, 42, 43, and 44 can be accurately maintained, so that degradation of receive sensitivity of the antennas caused by wrong installation of the antennas can be prevented.

In addition, the wireless antenna module 30 having the above structure may minimize the space occupied by the display device 20 when the antennas are installed, and can improve the external appearance of the display device because the wireless antenna module 30 is installed in the display device.

Although FIG. 3 shows the antenna module 30 fixed to the inner surface of the front case 21 of the display device 20, the antenna module 30 can also be installed in the signal converter 10 through the same manner as described above.

Figure 5:
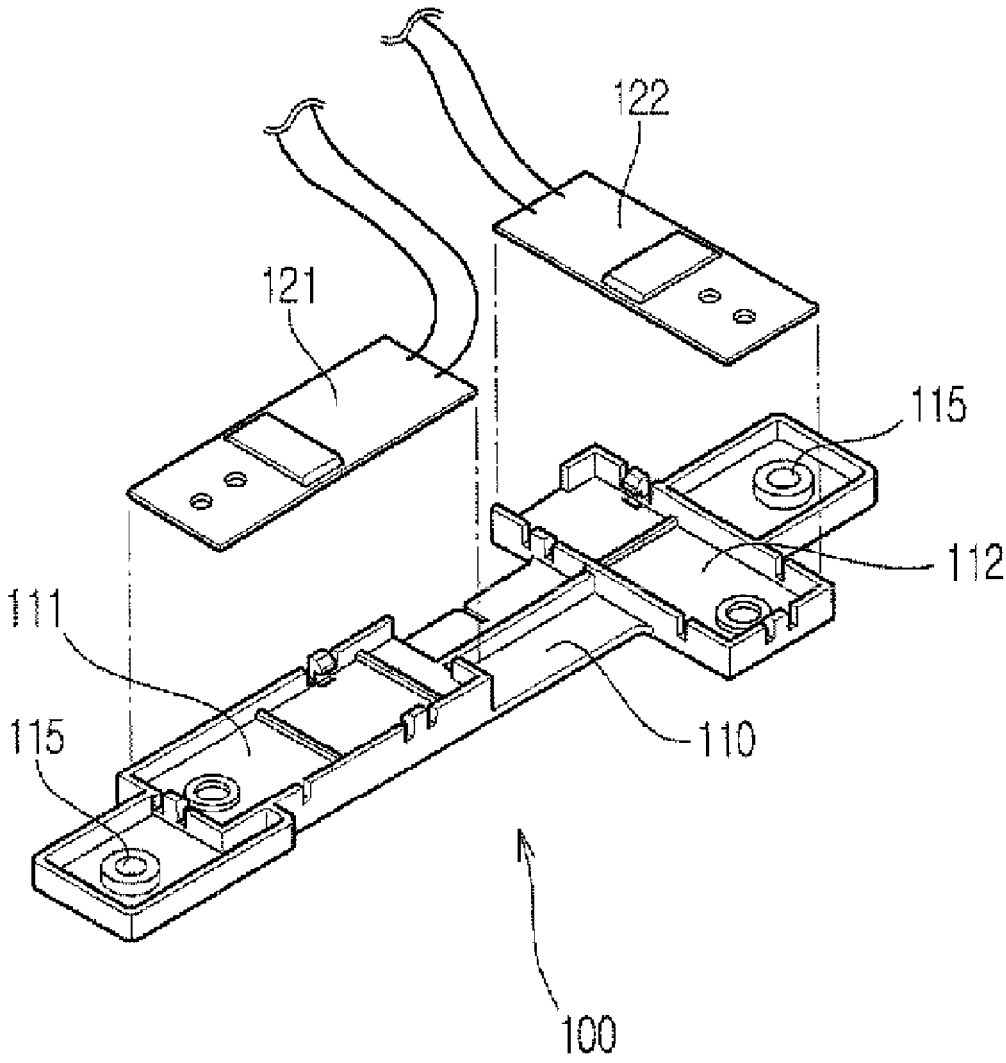
FIG. 5 is an exploded perspective view illustrating a wireless antenna module according to a second exemplary embodiment of the present invention.

FIG. 5 shows a wireless antenna module 100 according to a second exemplary embodiment of the present invention. The wireless antenna module 100 includes an antenna holder 110 having first and second antenna couplers 111 and 112, a first antenna 121 coupled to the first antenna coupler 111 that mainly receives horizontal components of RF signals, and a second antenna 122 coupled to the second antenna coupler 112 that mainly receives vertical components of RF signals. Screw holes 115 are formed at both sides of the antenna holder 110, and fixing screws (not shown) are screw-coupled into the screw holes 115. Thus, it is possible to fix the first and second antennas 121 and 122 of the wireless antenna module 100 in the display device 20 or the signal converter 10 through the antenna holder 110.

Figure 6:
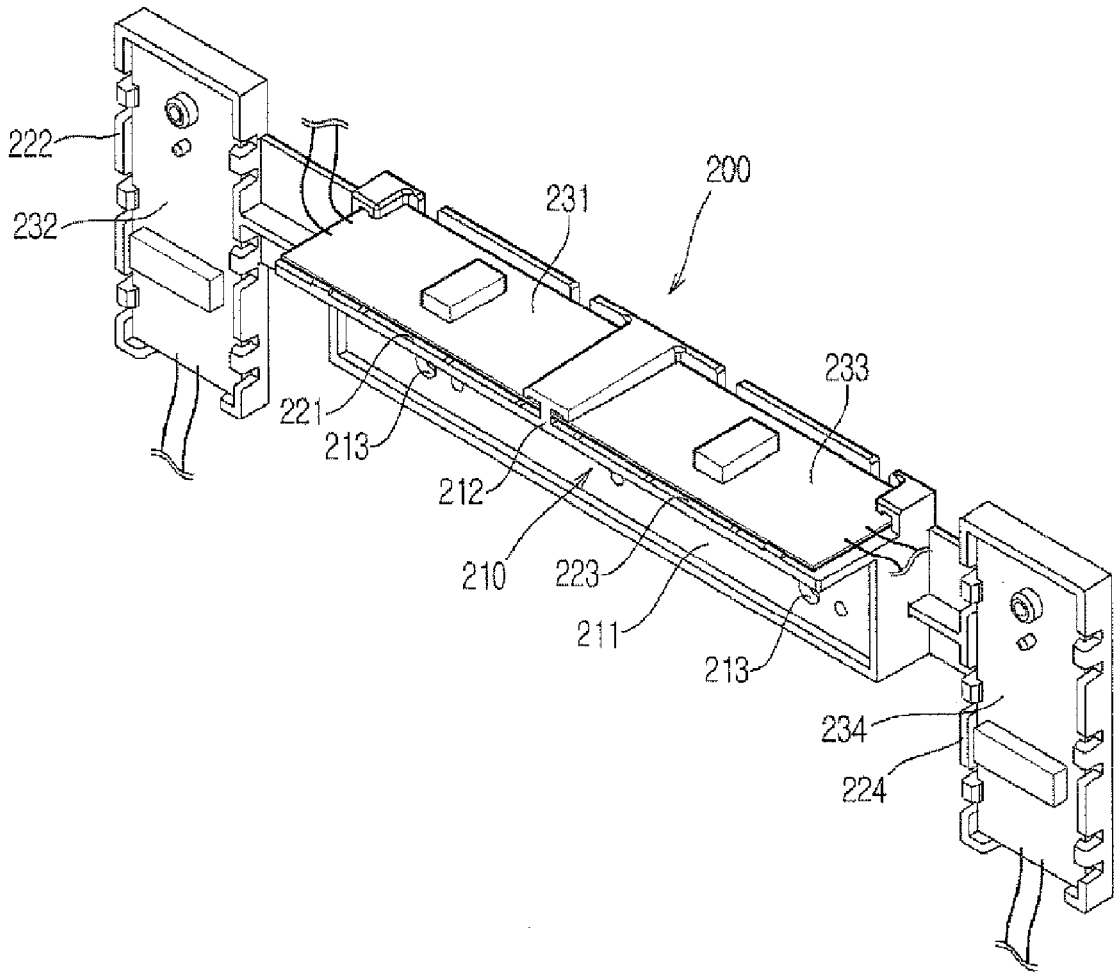
FIG. 6 is an exploded perspective view illustrating a wireless antenna module according to a third exemplary embodiment of the present invention.

FIG. 6 shows a wireless antenna module 200 according to a third exemplary embodiment of the present invention. The wireless antenna module 200 includes an antenna holder 210 which is modified from the antenna holder 110 such that the wireless antenna module 200 can be easily installed in the signal converter 10 shown in FIG. 1. Of course, the wireless antenna module 200 can also be installed in the display device 20.

The antenna holder 210 includes a base 211 fixed to a front inner surface of a case, and a horizontal supporter 212 provided on an upper end portion of the base 211 perpendicularly to the base 211. First and third antenna couplers 221 and 223 are provided on the top surface of the horizontal supporter 212 such that the first and third antenna couplers 221 and 223 can be coupled with first and third antennas 231 and 233, which mainly receive horizontal components of RF signals.

In addition, second and fourth antenna couplers 222 and 224 are provided at both sides of the base 211 such that the second and fourth antenna couplers 222 and 224 can be coupled with second and fourth antennas 232 and 234 which mainly receive vertical components of RF signals. The second and fourth antenna couplers 222 and 224 are longitudinally aligned on the substantially same plane with the base 211. Screw holes 213 are formed in the base 211, and fixing screws (not shown) are screw-coupled into the screw holes 213 in order to fix the antenna holder 210.

The antenna holder 210 is arranged such that the first antenna coupler 221 can be disposed perpendicularly to the second antenna coupler 222 and the third antenna coupler 223 can be disposed perpendicularly to the fourth antenna coupler 224. The antenna holder 210 is integrally fabricated through an injection molding process by using resin materials.

The antennas 231, 232, 233 and 234 can be easily installed in the signal converter 10 or the display device 20 by using the antenna holder 210 having the above structure. Thus, the orientation and interval of the antennas can be accurately maintained when the antennas are installed, so that degradation of receive sensitivity of the antennas caused by wrong installation of the antennas can be prevented.

As described above, according to the wireless antenna module of the exemplary embodiment of the present invention, the antenna holder can be installed in the signal converter or the display device in a state in which the antennas have been press-fitted into antenna couplers of the antenna holder. This allows the antennas to be easily installed in the signal converter or the display device.

In addition, since the wireless antenna module can be installed in the signal converter or the display device in a state in which the antennas have been fixed to the antenna holder, the orientation and interval of the antennas can be accurately maintained when the antennas are installed. Thus, degradation of receive sensitivity of the antennas caused by wrong installation of the antennas can be prevented.

Furthermore, since a plurality of antennas can be coupled to the antenna holder, the size of the wireless antenna module can be minimized. In addition, since the wireless antenna module is installed in the signal converter or the display device, the external appearance of the signal converter or the display device can be improved.

Although exemplary embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A wireless antenna module comprising:

a plurality of antennas that transmit and/or receive radio frequency (RF) signals; and an antenna holder that fixes the antennas to an appliance, wherein the antenna holder includes a plurality of antenna couplers, each antenna coupler being coupled with a respective antenna, wherein the antennas include a first antenna that mainly receives horizontal components of the RF signals, and a second antenna that mainly receives vertical components of the RF signals, and the antenna couplers include a first antenna coupler that fixes the first antenna and a second antenna coupler that fixes the second antenna such that an orientation of the second antenna is different from an orientation of the first antenna.

2. The wireless antenna module as claimed in claim 1, wherein the second antenna coupler is spaced apart from the first antenna coupler.

3. The wireless antenna module as claimed in claim 2, wherein each of the first and second antenna couplers includes recesses for receiving the antennas and at least one fixing protrusion for fixing the antenna received in the recess.

4. The wireless antenna module as claimed in claim 3, wherein the orientation of the second antenna is perpendicular to the orientation of the first antenna.

5. The wireless antenna module as claimed in claim 1, wherein the antennas further include a third antenna that mainly receives horizontal components of the RF signals, and a fourth antenna that mainly receives vertical components of the RF signals, and the antenna couplers further include a third antenna coupler that fixes the third antenna and a fourth antenna coupler that fixes the fourth antenna such that an orientation of the fourth antenna is different from an orientation of the third antenna.

6. The wireless antenna module as claimed in claim 5, wherein the fourth antenna coupler is spaced apart from the third antenna coupler.

7. The wireless antenna module as claimed in claim 6, wherein each of the third and fourth antenna couplers includes a recess that receives the antenna and at least one fixing protrusion that fixes the received antenna in the recess.

8. A display device comprising:

a display module that displays images;

a case that protects the display module; and a wireless antenna module installed in the case that transmits and/or receives RF signals, wherein the wireless antenna module includes a plurality of antennas that transmit and/or receive the RF signals and an antenna holder that fixes the antennas to an appliance, wherein the antenna holder includes a plurality of antenna couplers, each antenna coupler being coupled with a respective antenna, wherein the antennas include a first antenna that mainly receives horizontal components of the RF signals, and a second antenna that mainly receives vertical components of the RF signals, and the antenna couplers include a first antenna coupler that fixes the first antenna and a second antenna coupler that fixes the second antenna such that an orientation of the second antenna is different from an orientation of the first antenna.

9. The display device as claimed in claim 8, wherein the second antenna coupler is spaced apart from the first antenna coupler.

10. The display device as claimed in claim 9, wherein each of the first and second antenna couplers includes a recess that receives the antenna and at least one fixing protrusion that fixes the received antenna in the recess.

11. The display device as claimed in claim 10, wherein the orientation of the second antenna is perpendicular to the orientation of the first antenna.

12. The display device as claimed in claim 8, wherein the antennas further include a third antenna that mainly receives horizontal components of the RF signals, and a fourth antenna that mainly receives vertical components of the RF signals, and the antenna couplers further include a third antenna coupler that fixes the third antenna and a fourth antenna coupler that fixes the fourth antenna such that an orientation of the fourth antenna is different from an orientation of the third antenna.

13. The display device as claimed in claim 12, wherein the fourth antenna coupler is spaced apart from the third antenna coupler.

14. The display device as claimed in claim 13, wherein each of the third and fourth antenna couplers includes a recess that receives the antenna and at least one fixing protrusion that fixes the received antenna in the recess.

15. A display system comprising:

a display device;

an external device separated from the display device that outputs audio and video signals; and wireless antenna modules installed in the display device and the external device, respectively, that provide wireless communication between the display device and the external device, wherein the wireless antenna module includes a plurality of antennas that transmit and/pr receive RF signals and an antenna holder that fixes the antennas to the display device or the external device, wherein the antenna holder includes a plurality of antenna couplers, each antenna coupler being coupled with a respective antenna, wherein the antennas include a first antenna that mainly receives horizontal components of the RF signals, and a second antenna that mainly receives vertical components of the RF signals, and the antenna couplers include a first antenna coupler that fixes the first antenna and a second antenna coupler that fixes the second antenna such that an orientation of the second antenna is different from an orientation of the first antenna.

16. The display system as claimed in claim 15, wherein the second antenna coupler is spaced apart from the first antenna coupler.

17. The display system as claimed in claim 16, wherein each of the first and second antenna couplers includes a recess that receives the antenna and at least one fixing protrusion that fixes the received antenna in the recess.

18. The display system as claimed in claim 17, wherein the orientation of the second antenna is perpendicular to the orientation of the first antenna.

19. The display system as claimed in claim 15, wherein the antennas further include a third antenna that mainly receives horizontal components of the RF signals, and a fourth antenna that mainly receives vertical components of the RF signals, and the antenna couplers further include a third antenna coupler that fixes the third antenna and a fourth antenna coupler that fixes the fourth antenna such that an orientation of the fourth antenna is different from an orientation of the third antenna.

20. The display system as claimed in claim 19, wherein the fourth antenna coupler is spaced apart from the third antenna coupler.

21. The display system as claimed in claim 20, wherein each of the third and fourth antenna couplers includes a recess that receives the antenna and at least one fixing protrusion that fixes the received antenna in the recess.

* * * * *